US006530503B2

(12) United States Patent
Sato

(10) Patent No.: US 6,530,503 B2
(45) Date of Patent: Mar. 11, 2003

(54) INK BOTTLE SET-UP DEVICE

(75) Inventor: Yuji Sato, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 219 days.

(21) Appl. No.: 09/782,221

(22) Filed: Feb. 14, 2001

(65) Prior Publication Data

US 2001/0015146 A1 Aug. 23, 2001

(30) Foreign Application Priority Data

Feb. 22, 2000 (JP) ..... 2000-044895

(51) Int. Cl.[7] ..... B65D 88/54
(52) U.S. Cl. ..... 222/325
(58) Field of Search ..... 222/325

(56) References Cited

U.S. PATENT DOCUMENTS 3,685,694 A * 8/1972 Ianelli ..... 222/325
5,100,030 A * 3/1992 Roggenburg et al. ..... 222/325
5,174,476 A * 12/1992 Steiner et al. ..... 222/207
5,261,568 A * 11/1993 Corby et al. ..... 222/325
5,613,625 A * 3/1997 Specht ..... 222/325
6,095,370 A * 8/2000 Rhine et al. ..... 222/325
6,283,330 B1 * 9/2001 Gillespie et al. ..... 222/325
6,412,666 B1 * 7/2002 Hogan et al. ..... 222/325

FOREIGN PATENT DOCUMENTS

EP 0 712 733 5/1996

* cited by examiner

*Primary Examiner*—Kenneth Bomberg
(74) *Attorney, Agent, or Firm*—Nath & Associates PLLC; Gary M. Nath; Marvin C. Berkowitz

(57) ABSTRACT

An ink bottle set-up device having a bottle set-up body 2 formed with a bottle set-up chamber 3 and a projection-guide recess formed along a direction in which an ink bottle 100 having a positioning projection 103 is inserted. An ink bottle erroneous set-up prevention mechanism 6 is located on the bottle set-up body and comprises a detecting lever 9 moveable in protruding or retracting positions and urged toward the protruding position, a slide member 12 slidable in bottle inserting or bottle discharging directions for selectively allowing the ink bottle to be inserted through the bottle set-up chamber when the positioning projection in alignment with the projection-guide recess is detected by the detecting lever, and a bottle stopper segment 14 secured to the slide member 12 and protruding into the bottle set-up chamber 3.

15 Claims, 10 Drawing Sheets

INK BOTTLE SET-UP DEVICE

BACKGROUND OF THE INVENTION

The present invention relates to an ink bottle set-up device, and more particularly, to an ink bottle set-up device for setting up an ink bottle having a positioning projection in a given position.

One typical example of an ink bottle is shown in FIG. 8. As shown in FIG. 8, an ink bottle 100 is made of plastic and comprises a cylindrical bottle body 101 internally filled with an ink, with a bottom wall having an ink discharging section 102 formed at a central position of the bottom wall. An outer periphery of the bottle body 101 is formed with three positioning ribs (positioning projections) 103 which extend along the length of the ink body 101, i.e., along an inserting direction of the ink bottle 100. The bottom wall of the bottle body 101 is also formed with an information indicating rib

SUMMARY OF THE INVENTION

In view of the present inventor, an ink bottle set-up device for which the ink bottle 100 is set up is shown in FIGS. 9 and 10. FIG.9 is a front view of the ink bottle set-up device wherein the ink bottle 100 is located in a set-up position, and FIG. 10 is a cross sectional view taken along line X—X of FIG. 9. As shown in FIGS. 9 and 10, a bottle set-up body 105 is formed with a bottle set-up chamber 106, and a rib-guide recess 107 opening to the bottle set-up chamber 106 and extending in a direction along the inserting direction of the ink bottle 100. An innermost end of the bottle set-up chamber 106 has an ink receptor section 108 formed at a central position of the bottle set-up chamber 106. Also, the innermost end of the bottle set-up chamber 106 is formed with an information detecting sensor 109 in the vicinity of the ink receptor section 108 for detecting a bottle-in state, an ink color, etc.

With such a structure, the ink bottle 100 is inserted into the bottle set-up chamber 106 while the positioning ribs 103 of the ink bottle 100 are held in alignment with the rib-guide recess 107. During this inserting step, the positioning ribs 10 move along the rib-guide recess 107 such that the ink bottle 100 is inserted into the bottle set-up chamber 106 in a given rotated orientation. Finally, the bottle 100 is set up and the ink discharging section 102 is fitted to the sink receptor section 108, and the information indicating rib 104 is detected by the information detecting sensor 109.

That is, the positioning ribs 103 of the ink bottle 100 is aligned with the rib-guide recess 107 and, under this condition, the ink bottle 100 is inserted into the bottle set-up chamber 106 in the given rotated orientation. Owing to this inserting movement, it is possible for the information detecting sensor 109 to correctly detect necessary information from the ink bottle 100 and rotational movement of the ink bottle 100 is prevented from avoiding rupturing of the information detecting sensor 109 after the ink bottle 100 is set up in the given position.

In such an ink bottle set-up device, however, since it is possible for an ink bottle 100 with no positioning projections 103 to be inserted into the bottle set-up chamber 106 provided that the ink bottle 100 has a diameter substantially equal to that of the ink bottle formed with the positioning projections and the ink bottle 100 is allowed to rotate after the set-up condition of the ink bottle 100, it is appeared that the information detecting sensor 103 is influenced owing to undesirable rotation of the ink bottle 100.

Further, since the ink bottle 100 is made of plastic that is apt to swell owing to an inherent property of material absorbing ink, a consideration has been undertaken that the bottle set-up chamber 106 is designed to be slightly larger in diameter than the ink bottle 100. As a result, the ink bottle 100 is undesirably caused to be inserted into the bottle set-up chamber 106 even in a case where the positioning ribs 103 are out of alignment with the rib-guide recess 107. If the ink bottle 100 is inserted in an incorrectly rotated orientation, the ink discharging section 102 of the ink bottle 100 is set up in a wrong position displaced from the ink receptor section 108 of the bottle set-up body 105 and it may be difficult for the information detecting sensor 109 to correctly detect information of the ink bottle 100.

The present invention has been made in view of the above-described investigation by the present inventor and has an object to provide an ink bottle set-up device which can overcome the above various phenomenon by preventing an incorrect ink bottle having no positioning provision from being erroneously inserted and by preventing a correct ink bottle with a positioning projection from being erroneously inserted in an incorrectly rotated orientation.

In the present invention, an ink bottle set-up device setting up an ink bottle having a positioning projection is provided with: a bottle set-up body having a bottle set-up chamber adapted to receive the ink bottle, and a projection-guide recess guiding the positioning projection; and an ink bottle erroneous set-up prevention mechanism including a projection detecting member detecting that the positioning projection is inserted into the projection-guide recess, and a bottle stopper member allowing the ink bottle to be inserted into the bottle set-up chamber, when the projection detecting member detects that the positioning projection is inserted into the projection-guide recess, for thereby enabling the ink bottle to be set up in a given position of the set-up chamber. The bottle stopper member prevents the ink bottle from being inserted into the bottle set-up chamber when the projection detecting member detects that the positioning projection is out of alignment with the protection-guide recess.

In other words, in the present invention, an ink bottle set-up device setting up an ink bottle having a positioning projection is provided with: a bottle set-up body having a bottle set-up chamber adapted to receive the ink bottle, and a projection-guide recess guiding the positioning projection; and an ink bottle erroneous set-up prevention mechanism including a projection detecting means for detecting that the positioning projection is inserted into the projection-guide recess, and a bottle stopper means for allowing the ink bottle to be inserted into the bottle set-up chamber, when the projection detecting means detects that the positioning projection is inserted into the projection-guide recess, for thereby enabling the ink bottle too be set up in a given position of the set- up chamber. The bottle stopper means prevents the ink bottle from being inserted into the bottle set-up chamber when the projection detecting means detects that the positioning projection is out of alignment with the projection-guide recess.

Other aspect and advantages of the invention will become more apparent from the following description, taken in conjunction with the accompanying drawings, illustrating by way of example the principles of the invention.

DETAILED DESCRIPTION OF THE PREFERRED EMBODIMENTS

Figure 1:
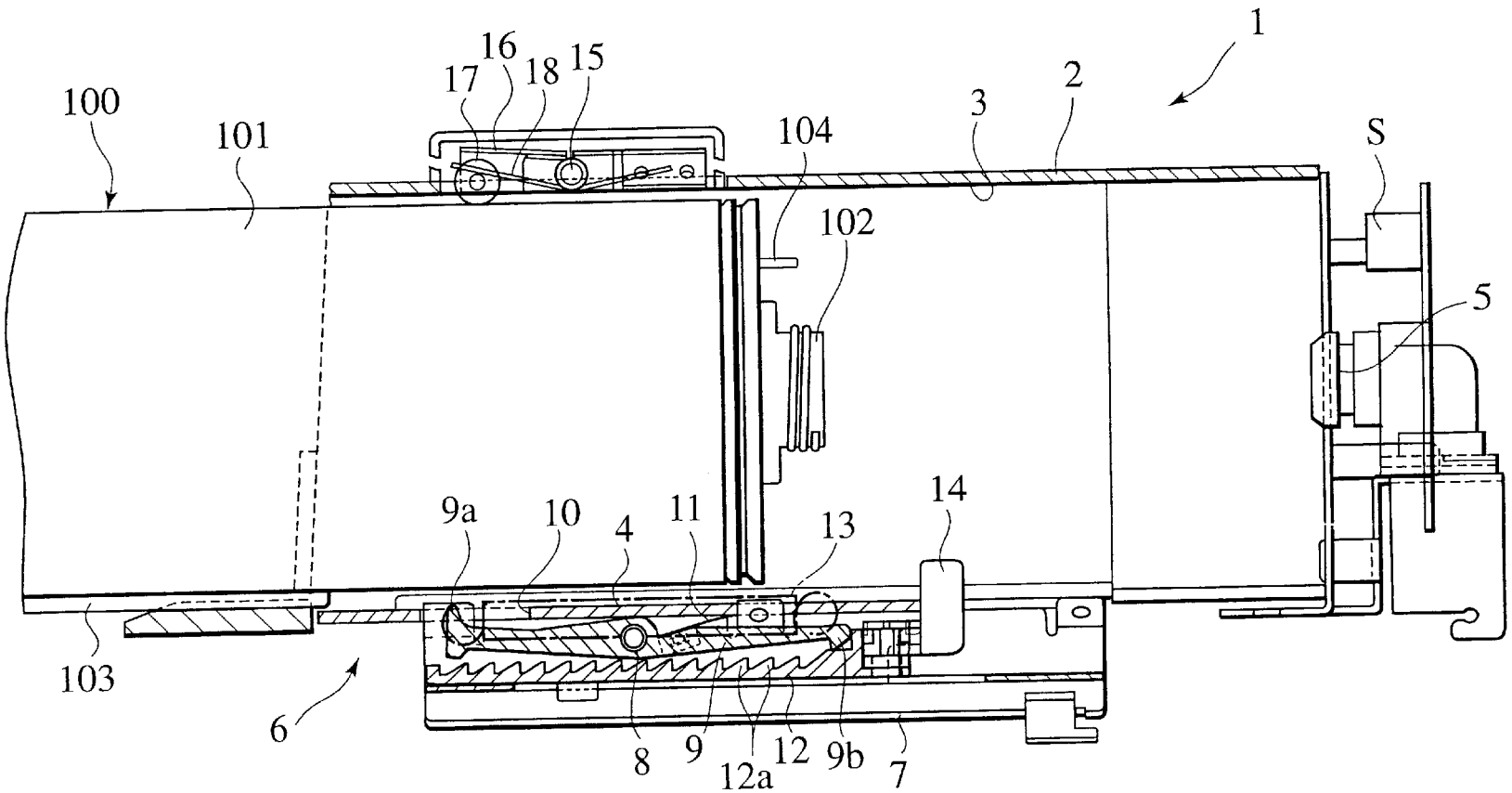
FIG. 1 is a cross sectional view of a preferred embodiment of an ink bottle set-up device according to the present invention, wherein an ink bottle is located at an initial insertion starting position.
Figure 2:
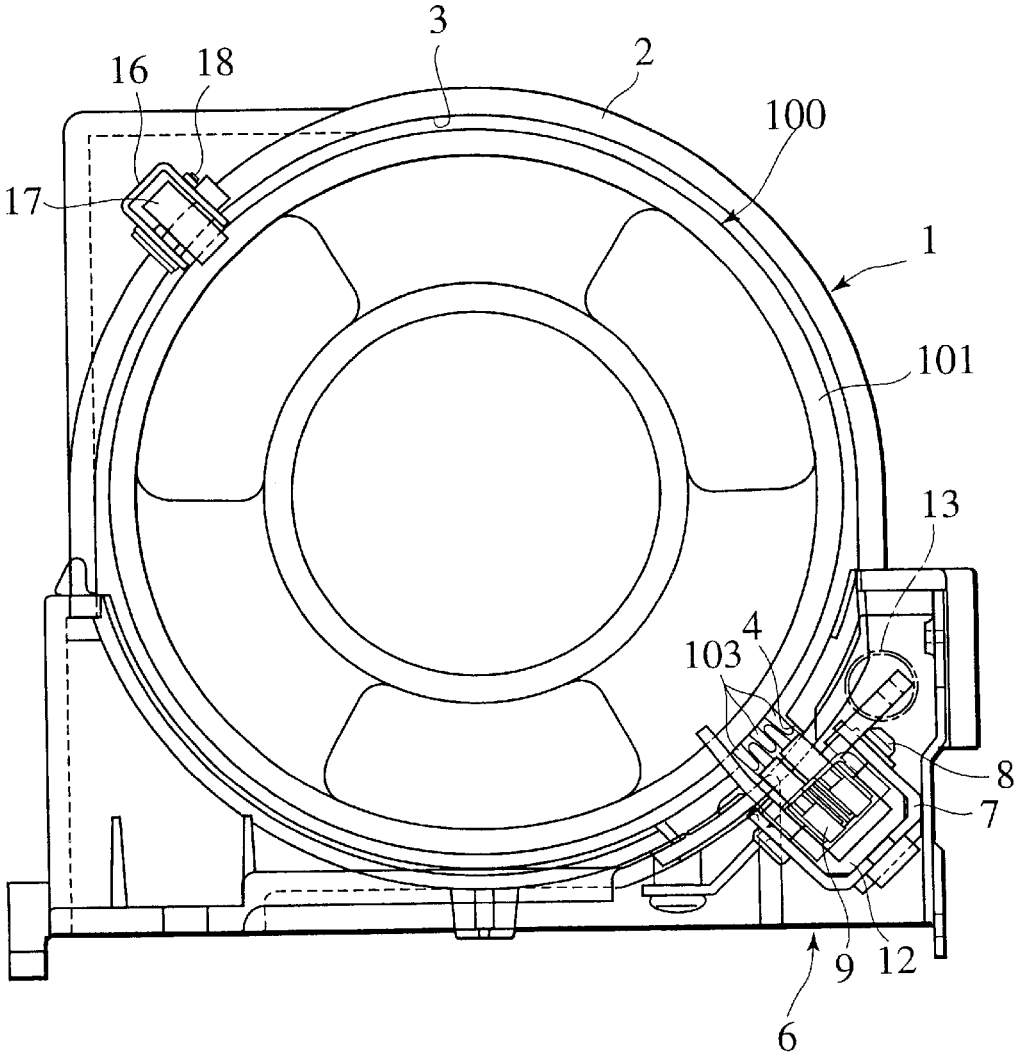
FIG. 2 is a front view of the preferred embodiment of the ink bottle set-up device, wherein the ink bottle has been set up in a final set-up position.
Figure 3:
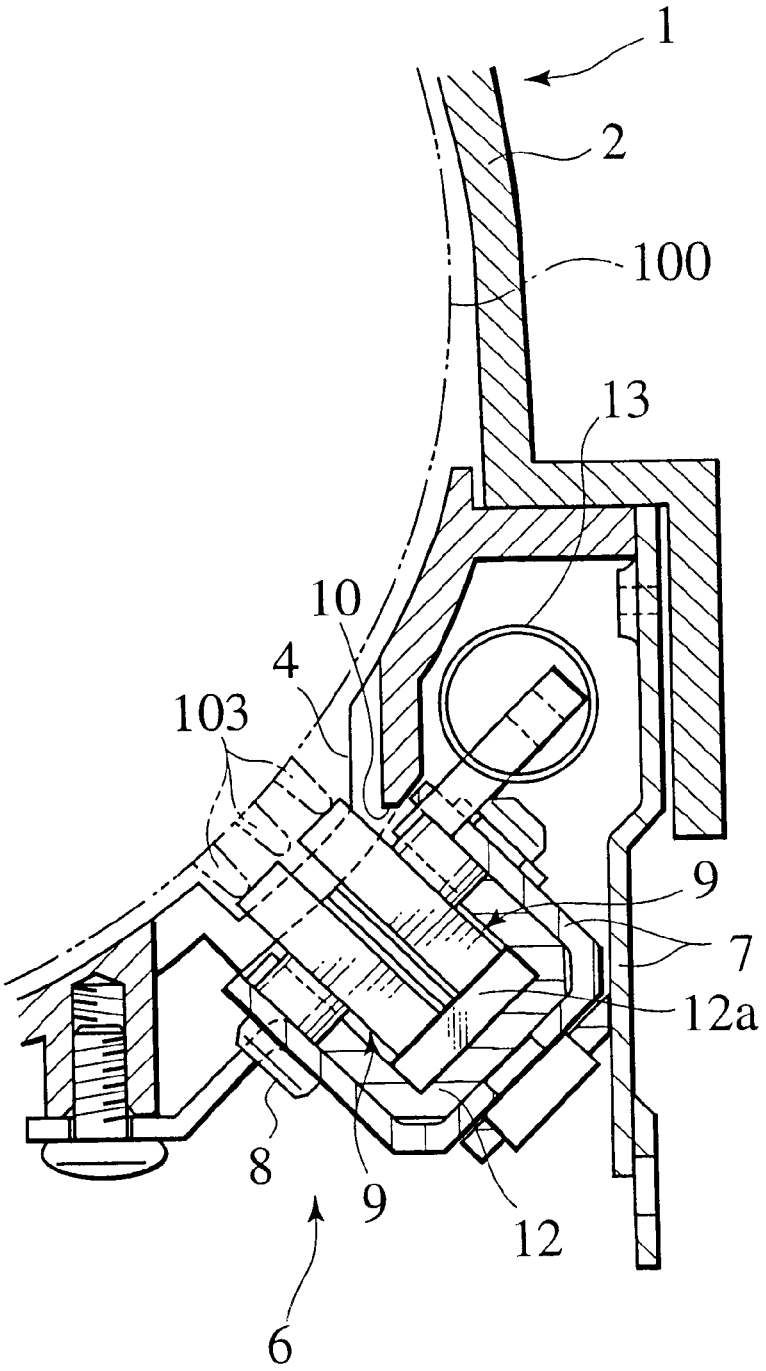
FIG. 3 is an enlarged cross sectional view of an erroneous ink bottle inserting prevention mechanism forming part of the ink bottle set-up device shown in FIG. 1.
Figure 4:
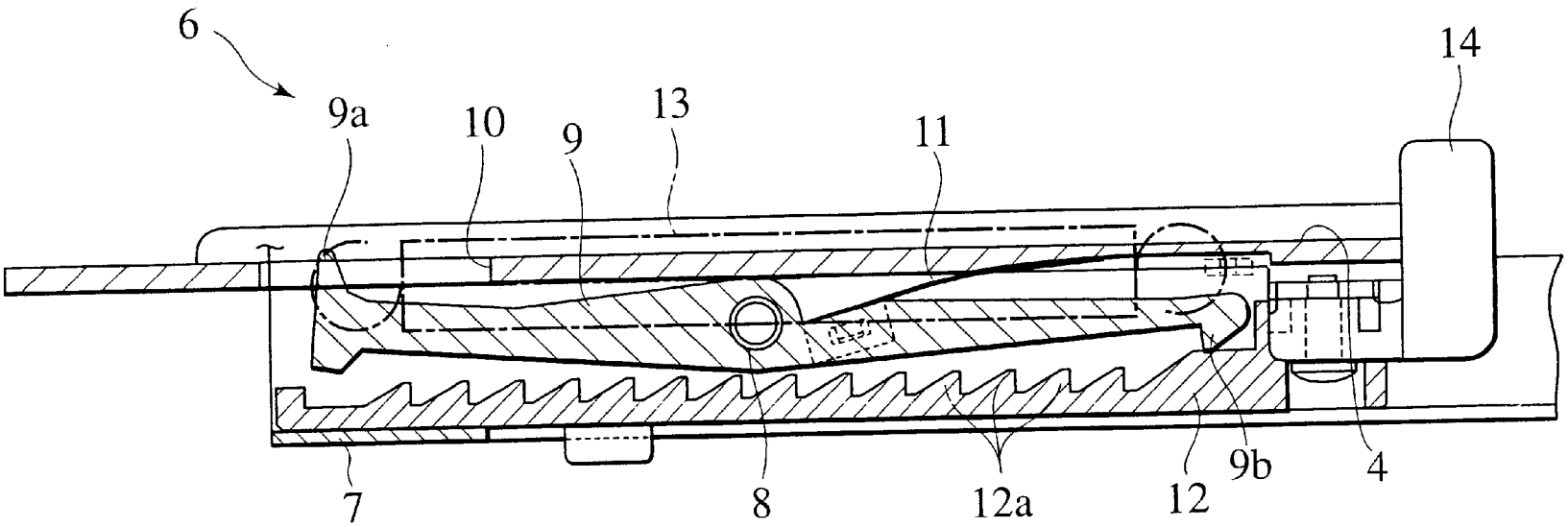
FIG. 4 is an enlarged cross sectional view of another part of the ink bottle set-up device shown in FIG. 1.
Figure 5:
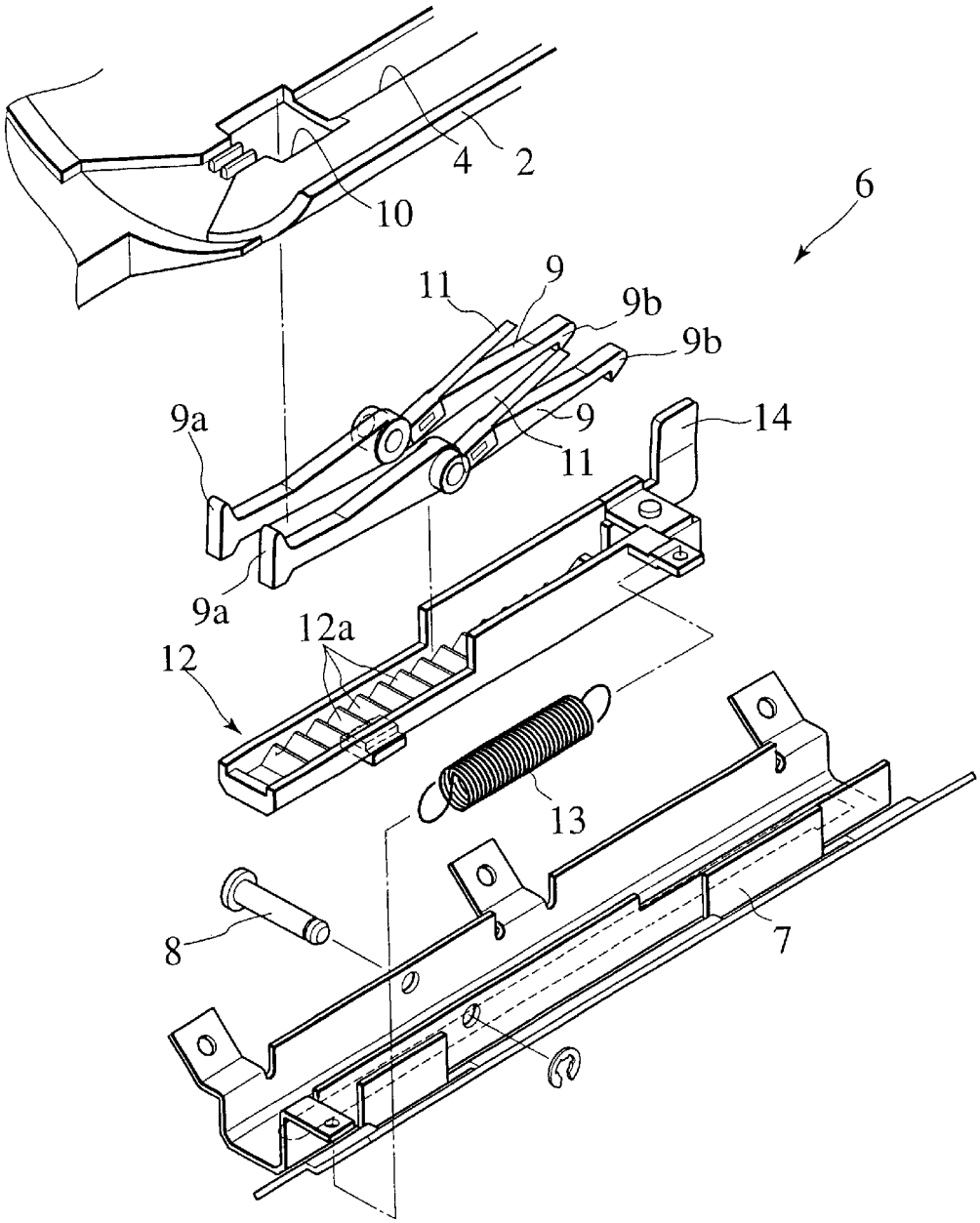
FIG. 5 is an enlarged, exploded view of the erroneous ink bottle inserting prevention mechanism shown in FIG. 4.
Figure 6A:
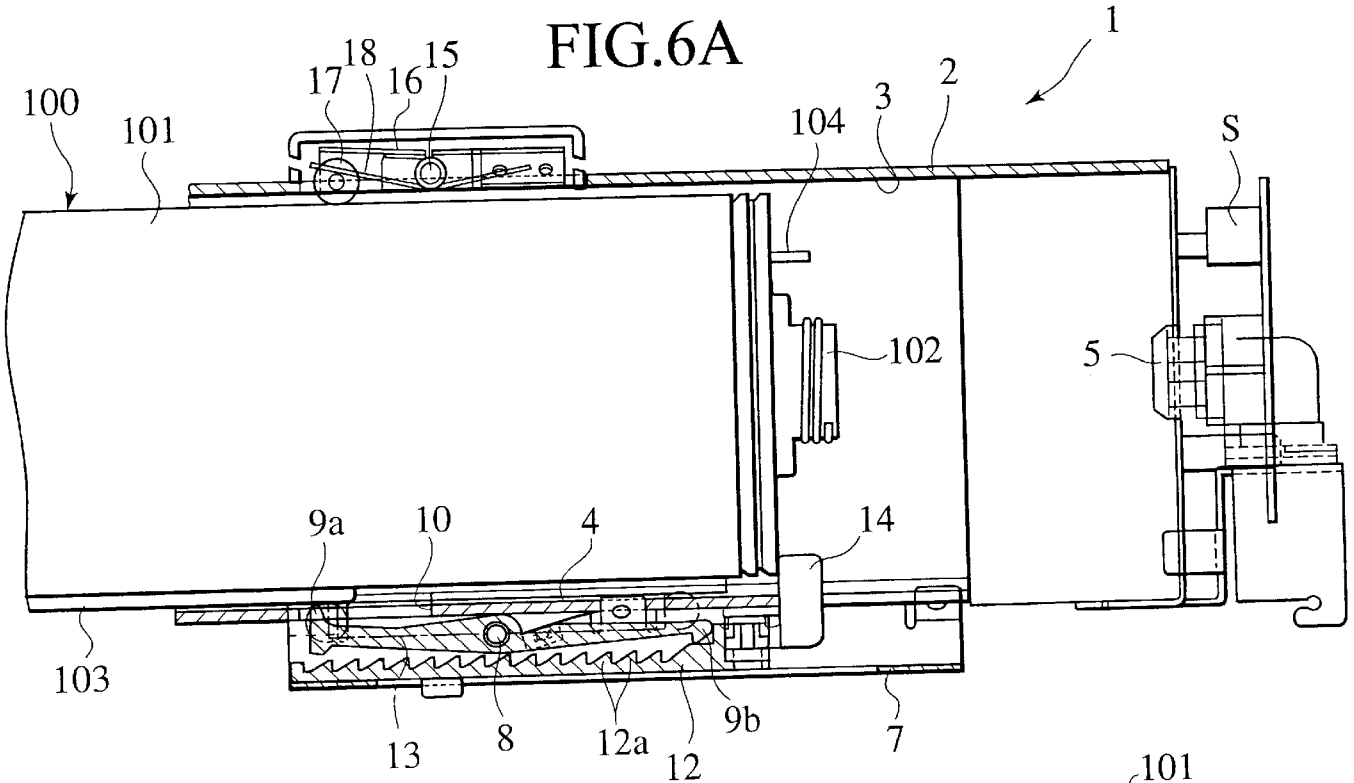
FIG. 6A is a cross sectional view of the preferred embodiment of the ink bottle set-up device, wherein the ink bottle is located at a halfway of an inserting stroke of the ink bottle.
Figure 6B:
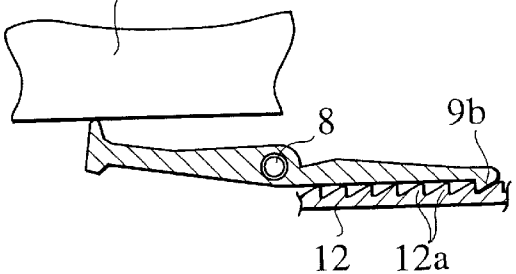
FIG. 6B is a part of a cross sectional view of the preferred embodiment of the ink bottle set-up device, wherein an unsuitable ink bottle is located at a halfway of an inserting stroke of the ink bottle.
Figure 7:
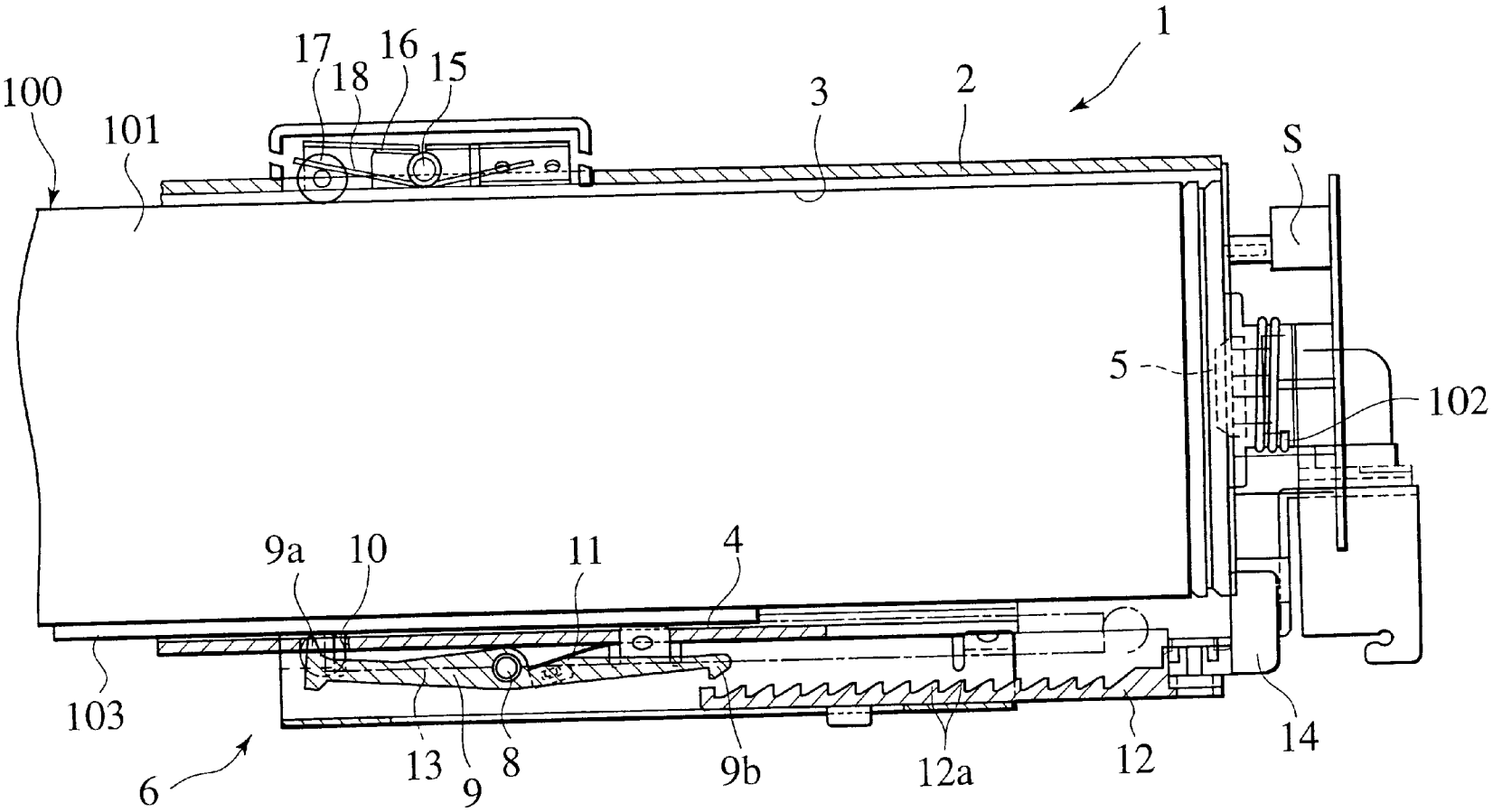
FIG. 7 is a cross sectional view of the preferred embodiment of the ink bottle set-up device, wherein the ink bottle has been located in a final set-up position.
Figure 8:
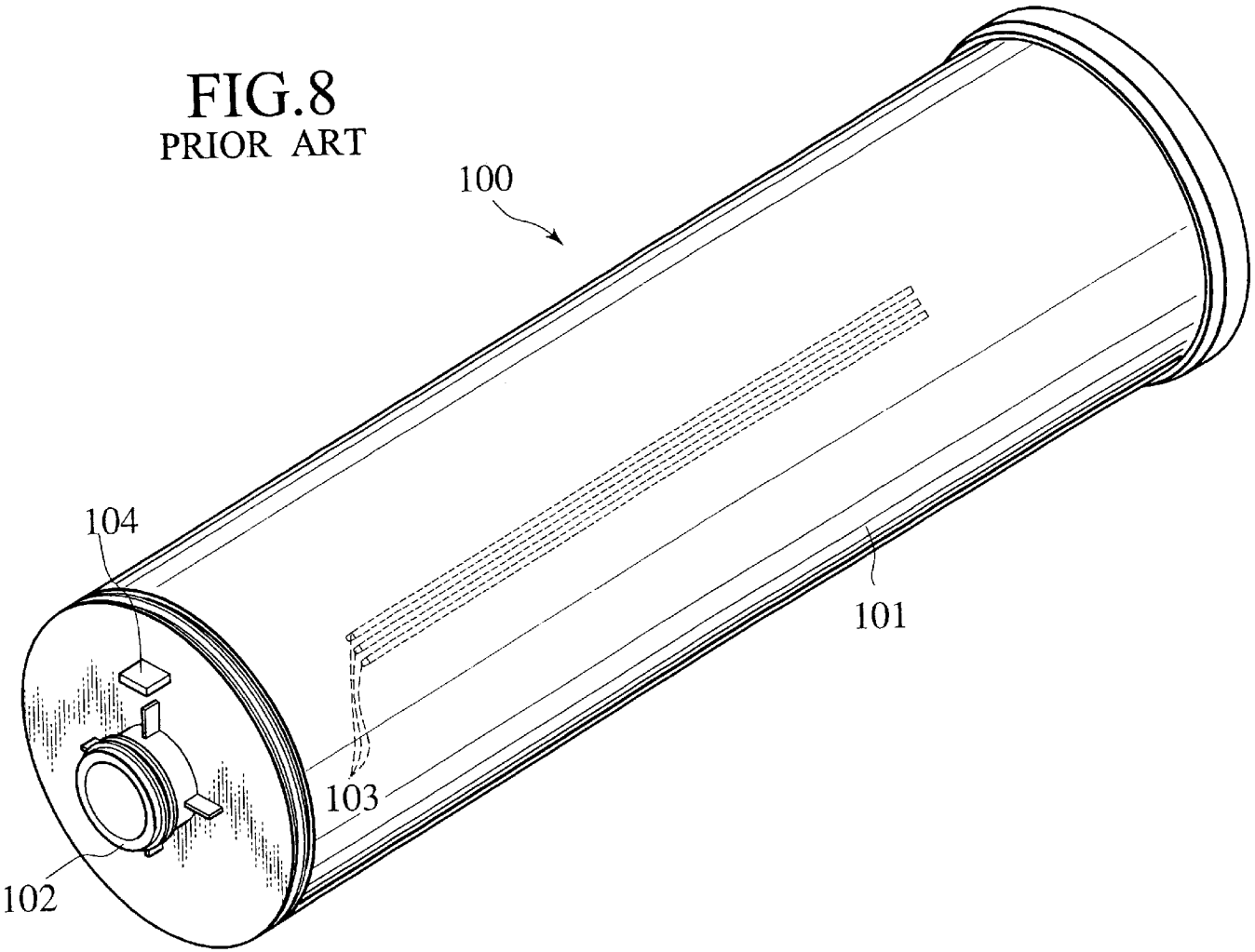
FIG.8 PRIOR ART
FIG. 8 is a perspective view of an ink bottle in the related art.
Figure 9:
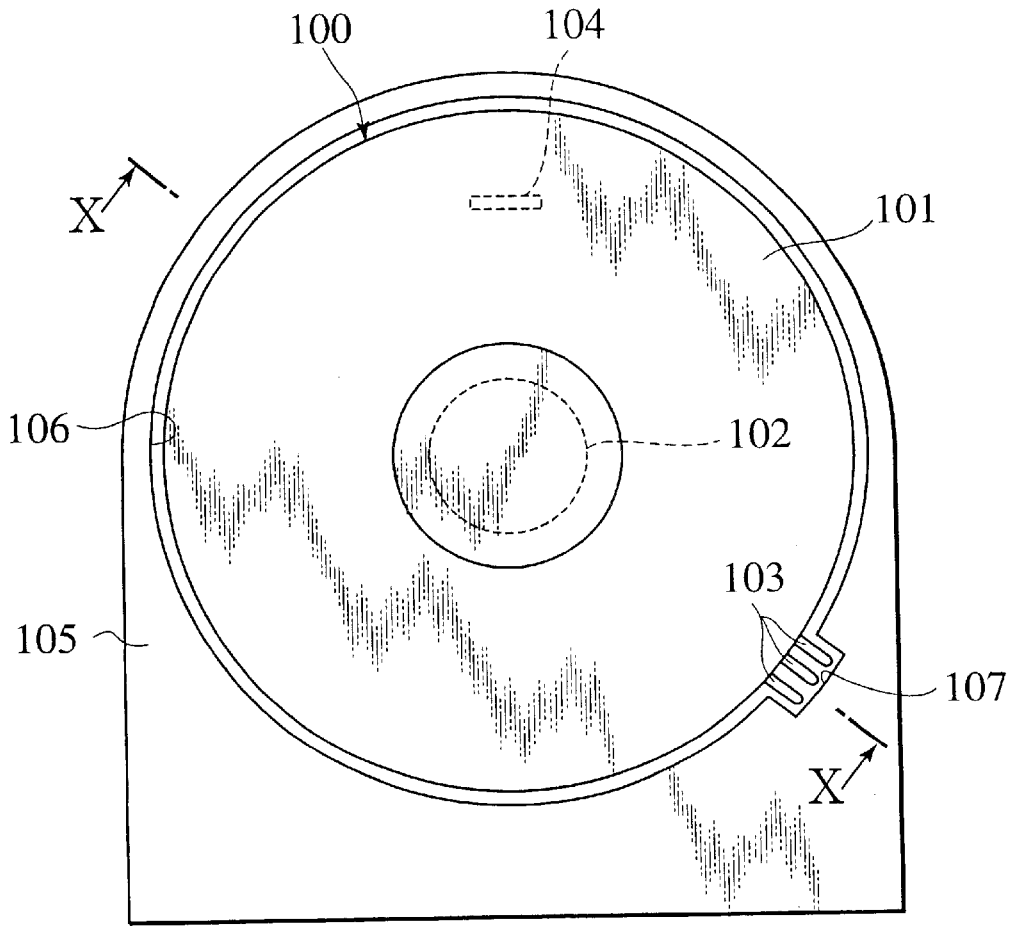
FIG. 9 is a front view of an ink bottle set-up device studied by the present inventor, wherein the ink bottle is located in a final set-up position.
Figure 10:
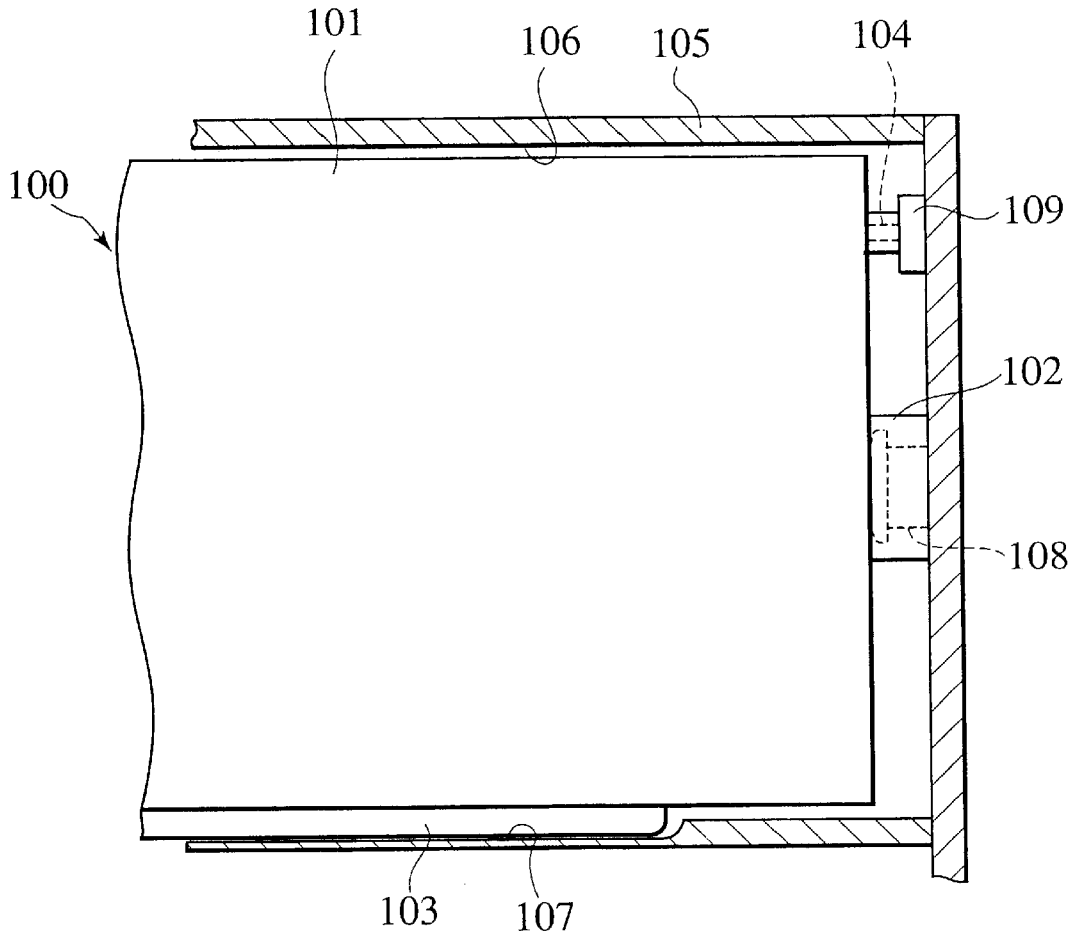
FIG. 10 is a cross sectional view taken on line X—X of FIG. 9.

Referring to FIGS. 1 to 7, there is shown a preferred embodiment of an ink bottle set-up device according to the present invention, wherein FIG. 1 is a cross sectional view of the ink bottle set-up device wherein an ink-bottle is located in an ink-bottle set-up starting position, FIG. 2 is a front view of the ink bottle set-up device showing a set-up condition of the ink bottle, FIG. 3 is an enlarged cross sectional view of an ink bottle erroneous set-up prevention mechanism, FIG. 4 is an enlarged cross sectional view of the ink-bottle erroneous set-up prevention mechanism, FIG. 5 is an exploded perspective view of the ink bottle erroneous set-up prevention mechanism, FIG. 6A is a cross sectional view of the ink-bottle mounting device wherein the ink bottle is located in a halfway of an inserting stroke, FIG. 6B is a part of a cross sectional view of the ink-bottle mounting device wherein an unsuitable ink bottle is located in a halfway of an inserting stroke and FIG. 7 is a cross sectional view of the ink bottle set-up device wherein the ink bottle is located in a set-up position. The ink bottle 100 has been already described above in detail with reference to FIG. 8 and, therefore, a detailed description of the same is herein omitted for the sake of simplicity.

In FIGS. 1 to 7, the ink-bottle mounting device 1 includes a bottle set-up body 2 that has a bottle set-up chamber 3. The bottle set-up chamber 3 has a cylindrical configuration that has one distal end formed with an opening. The bottle set-up chamber 3 is designed to have a diameter slightly larger than that of the ink bottle 100 that is made of plastic and swells in outer diameter owing to an inherent property of material that absorbs an ink. The bottle set-up body 2 has a rib guide recess (or a projecting guide recess) 4 that is open to the bottle set-up chamber 3 and extends in a bottle set-up direction. The bottle set-up chamber 3 has an innermost end formed with an ink receptor portion 5, which is located in a central position of the bottle set-up chamber 3. Further, an information detecting sensor S is located in the innermost end of the bottle set-up chamber 3 in the vicinity of the ink receptor portion 5 in order to detect information such as a bottle-in or an ink color.

As shown in FIGS. 3 to 5, the ink bottle set-up device 1 further includes an ink-bottle erroneous set-up prevention mechanism 6. The ink-bottle erroneous set-up prevention mechanism 6 includes a body bracket 7 secured to an outer periphery of the bottle set-up body 2 in the vicinity of the rib-guide recess 4, and a pair of detecting levers 9, as projection detecting members, rotatably supported by a pivot shaft 9 that is supported by the body bracket 7. A distal end of each detecting lever 9 has a projection 9*a* that is located in an opening 10 formed in the bottle set-up body 2 and is freely moveable owing to the pivotal movement of the detecting lever 9 between a protruding position wherein the projection 9*a* is exposed to the rib guide recess 4 and a retracted position wherein the projection 9*a* is retracted from the rib guide recess 4. As best shown in FIGS. 4 and 5, each of the detecting levers 9 has the other distal end to which one end of a leaf spring 11 is secured, with the other end of the leaf spring 9 being held in abutting engagement with the bottle set-up body 2 such that the detecting levers 9 are urged toward the protruding position by the actions of the leaf springs 11, respectively. Other distal end of each detecting lever 9 has a stopper projection or claw 9*b* that is adapted to selectively engage with one of a series of engaging teeth 12*a* of a slide member 12 extending parallel to the outer periphery of the bottle set-up body 2 along an longitudinal axis thereof.

The slide body 12 is disposed in the body bracket 7 for freely sliding movement along an axis parallel to a bottle set-up direction or a bottle discharging direction, and the series of engaging teeth 12*a* are formed on an upper surface of the slide body 12. One end of a tension spring 13 is connected to the other distal end of the slide member 12 and the other end of the tension spring 13 is connected to one distal end of the body bracket 7 such that the slide member 12 is urged toward the bottle discharging direction by an action of the tension spring 13. Further, a bottle stopper segment 14 is firmly secured to the other distal end of the slide member 12 and extends inward in the bottle set-up chamber 3. Here, note should be taken that a bottle stopper member is formed with the slide member 12 and the bottle stopper segment 14.

Turning back to FIGS. 1 and 2, the bottle set-up body 2 has a support member composed of an arm member 16 located in a position opposite to the ink-bottle erroneous set-up prevention mechanism 6, with the arm member 16 having one distal end that supports a biasing roller 17 for rotatable movement which serves as a part of a biasing member. The biasing roller 17 is freely moveable in a direction to allow the amount of projecting stroke of the biasing roller 17 to vary in the bottle set-up chamber 3 owing to the rotational movement of the arm member 16 and is urged inward in a protruding direction by the action of a twisted coil spring 18. That is, when the ink bottle 100 is inserted into the bottle set-up chamber 3, the outer periphery of the ink bottle 100 is urged toward an opposing side of the bottle set-up chamber 3.

In operation, when a correct ink bottle 100 having a positioning rib (i.e., a positioning projection) 103 is inserted into the bottle set-up body 2 in a suitably rotated orientation, the positioning rib 103 of the ink bottle 100 fits into the rib-guide recess 4 as viewed in FIG. 1. If, in this event, the ink bottle 100 is further inserted as shown in FIG. 6A, the positioning rib 103 of the ink bottle 100 that slides in the rib-guide recess 4 pushes each projections 9*a* of each detecting lever 9 against the actions of the leaf springs 11 such that each detecting lever 9 is rotated from an initial protruding position toward the retracted position and a distal end of the ink bottle 100 is caused to abut against the bottle stopper segment 14. With each detecting lever 9 being positioned in there tracted position, each stopper claw 9*b* of each detecting lever 9 is displaced from the opposing engaging teeth 12*a*, allowing the detecting levers 9 to move the slide member 12. Consequently, when the bottle stopper segment 14 is forced due to inserting movement of the ink bottle 100, the ink bottle 100 is caused to slide in a bottle set-up direction against the action of the tension spring 13 to allow a further inserting movement of the ink bottle 100. If, in this event, the ink bottle 100 is moved to a final rest or set-up position, the ink bottle 100 is locked in the final rest position, with a consequent set-up of the ink discharging section 102 of the ink bottle 100 relative to the ink receptor section 5 wherein the information indicating rib, 104 is detected by the information detecting sensor S.

On the contrary, if an unsuitable ink bottle 100 that does not have the positioning rib 103 is inserted, or if the ink bottle 100 that has the positioning rib 103 is inserted in an erroneously rotated orientation, then, the positioning rib 103 of the ink bottle 100 can not be accepted. Under these circumstances, if the ink bottle 100 is continuously inserted into the bottle set-up body 2 as shown in FIG. 6B, each projection 9*a* of each detecting lever 9 is not pushed such that it remains in its protruding position and the distal end of the ink bottle 100 is caused to rest on the bottle stopper segment 14. Under these conditions, if the ink bottle 100 is contemplated to be further inserted, the stopper claw 9*b* of the detecting lever 9 is brought into engagement with one of the series of the engaging teeth 12*a* by the actions of the leaf springs 11, 11, preventing the slide member 12 from further sliding. Accordingly, even when the ink bottle 100 is inserted and the bottle stopper segment 14 is urged, the slide member 12 can not move in the sliding direction and, therefore, a further inserting movement of the ink bottle 100 is prevented by the bottle stopper segment 14.

In the above preferred embodiment of the present invention, the primary advantage resides in that it is possible to prevent both undesired cases, namely, one for erroneous insertion of an incorrect ink bottle 100 with no positioning rib 103, and the other for erroneous insertion of the ink bottle 100 in unsuitably rotated orientation, for thereby avoiding influence caused in the information detecting sensor S due to undesired insertion of the unsuitable ink bottle 100 and its rotation. Since, also, the ink bottle 100 can not be inserted in unsuitably rotated orientation, it is possible to prevent situation wherein the ink discharging section 102 of the ink bottle 100 and the ink receptor section 5 of the bottle set-up body 2 are set-up in a wrongly displaced condition, or wherein the information detecting sensor S can not correctly detect information from the ink body 100.

Another advantage of the preferred embodiment of the present invention is that, when all of the two detecting levers (i.e., the projection detecting member) 9 detect the positioning rib 103, discrimination is made wherein the positioning rib 103 is inserted into the rib-guide recess 4 and, when either one of the detecting levers 9 is moved toward the retracted position, the slide member 12 is not allowed for sliding movement, thereby preventing erroneous detection of the positioning rib 103 in a reliable fashion. Although, in the preferred embodiment, the two detecting levers 9 are provided with respect to three rows of positioning ribs 103, three detecting levers 9 may be provided so as to correspond to three positioning ribs 103, thereby preventing the erroneous detection of the positioning ribs 103 in a further reliable manner. However, a single detecting lever 9 may also be provided with respect to the plural positioning ribs 103 and, further, the single detecting lever 9 may be provided with respect to a single positioning rib 103.

Another advantage of the preferred embodiment of the present invention resides in that the ink bottle 100 is urged in the opposing direction by the action of the biasing roller 17 as a part of the biasing member to permit the positioning rib 103 of the ink bottle 100 to be correctly inserted into the rib-guide recess 4, thereby preventing erroneous detection of the positioning ribs 103. That is, although a consideration is undertaken to design the bottle set-up chamber 3 so as to have a diameter slightly larger than that of the ink bottle 100 to provide a margin in a space to some extent to compensate for an inherent property of swelling material owing to absorbing the ink, it is possible to prevent erroneous detection of the positioning ribs 103.

A further advantage of the preferred embodiment of the present invention is the provision of the biasing member that is freely moveable in a direction to allow the amount of protruding stroke thereof to be varied in the bottle set-up chamber 3 and that includes the biasing roller 17 which is urged in the protruding direction and is freely rotatable. Since, in this event, the ink bottle 100 is inserted into the bottle set-up chamber 3 while the biasing roller 17 rotates and urges the ink bottle 100 toward the rib-guide recess 4, inserting resistance is not imparted to the ink bottle 100 to permit smooth insertion of the ink bottle 100, provided that the biasing member is not limited to a particular structure employed in the preferred embodiment and may have other structure that allow the ink bottle 100 to be urged in the opposing direction in the bottle set-up chamber 3.

A further advantage of the preferred embodiment of the present invention resides in that the projection detecting member is freely moveable between the protruding position wherein the projection protrudes into the rib-guide recess 4 and the retracted position wherein the projection is retracted from the rib-guide recess 4 and includes detecting levers 9 that are urged toward the protruding direction, thereby allowing the projection detecting member to be composed of only mechanical components. However, the projection detecting member is not limited to a particular structure employed in the preferred embodiment and may include other structure that can detect the positioning rib 103 which is correctly inserted into the rib-guide recess 4.

A further advantage of the preferred embodiment of the present invention resides in the provision of a bottle stopper member that is freely moveable in the bottle set-up direction and the bottle discharging direction, that is urged in the bottle discharging direction and that includes a slide member 12 which is prevented from sliding movement when the detecting levers 9 remain in the protruding position and is allowed to slide when the detecting levers 4 remain in the retracted position, and the bottle stopper segment 14 extending into the bottle set-up chamber 3. Thus, the bottle stopper member may include only mechanical components, provided that the bottle stopper member is not limited to a particular structure employed in the preferred embodiment and may include other structure wherein, when the projection detecting member detects the positioning ribs 103 that is inserted in the rib-guide recess 4, the ink bottle 100 is allowed to insert the ink bottle 100 into the bottle set-up chamber 3 and, when the projection detecting member does not detect the positioning ribs 103, the ink bottle 100 is prevented from being inserted into the bottle set-up chamber 13.

Incidentally, while, in the above preferred embodiment, the single information indicating rib 104 and the single information detection sensor S are located in the ink bottle 100 and the bottle mounting device 1, respectively, plural information indicating ribs and plural information detection sensors may be utilized.

While, in the preferred embodiment, the projection 104 is employed for indicating information of the ink bottle 100, information of the ink bottle 100 may be indicated with the use of other components such as the detecting levers 9 formed with segments like the projections and urged for enabling positioning of the ink bottle 100.

The entire content of a Patent Application No. TOKUGAN 2000-44895 with a filing date of Feb. 22, 2000 in Japan are hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. An ink bottle set-up device setting up an ink bottle having a positioning projection, comprising:

a bottle set-up body having a bottle set-up chamber adapted to receive the ink bottle, and a projection-guide recess guiding the positioning projection; and an ink bottle erroneous set-up prevention mechanism including a projection detecting member detecting that the positioning projection is inserted into the projection-guide recess, and a bottle stopper member allowing the ink bottle to be inserted into the bottle set-up chamber, when the projection detecting member detects that the positioning projection is inserted into the projection-guide recess, for thereby enabling the ink bottle to be set up in a given position of the set-up chamber, the bottle stopper member preventing the ink bottle from being inserted into the bottle set-up chamber when the projection detecting member detects that the positioning projection is out of alignment with the projection-guide recess.

2. An ink bottle set-up device according to claim 1, wherein the positioning projection extends along an insertion direction of the ink bottle.

3. An ink bottle set-up device according to claim 1, wherein the projection-guide recess is formed along the insertion direction of the ink bottle in the bottle set-up body and opening to the bottle set-up chamber.

4. An ink bottle set-up device according to claim 1, wherein the projection detecting member has a detecting lever freely moveable through the projection-guide recess between a protruding position thereof and a retracted position thereof.

5. An ink bottle set-up device according to claim 4, wherein the detecting lever is urged toward the protruding position thereof by a spring member.

6. An ink bottle set-up device according to claim 1, wherein the bottle stopper member has a slide member freely moveable in an inserting direction of the ink bottle and in a discharging direction of the ink bottle such that, when the detecting lever remains in the protruding position, sliding movement of the slide member is prevented and, when the detecting lever remains in the retracted position, the slide member is allowed to slide, and a bottle stopper segment firmly secured to the slide member and protruding into the bottle set-up chamber.

7. An ink bottle set-up device according to claim 6, wherein the slide member is urged in the discharging direction of the ink bottle by a spring member.

8. An ink bottle set-up device according to claim 1, wherein the positioning projection has a plurality of positioning ribs, and the projection detecting member has a plurality of detecting elements equal in number to the positioning ribs.

9. An ink bottle set-up device according to claim 1, wherein a biasing member urging the ink bottle toward the ink bottle erroneous set-up prevention mechanism is provided.

10. An ink bottle set-up device according to claim 9, wherein the biasing member is located in the bottle set-up chamber at a position opposite to the ink bottle erroneous set-up prevention mechanism.

11. An ink bottle set-up device according to claim 10, wherein the biasing member has a rotatable roller protruding in the bottle set-up chamber, and a supporting member supporting the rotatable roller such that the rotatable roller is freely moved in a direction to allow the rotatable roller to protrude in the bottle set-up chamber with a variable protruding stroke.

12. An ink bottle set-up device according to claim 11, wherein the rotatable roller is urged toward a protruding direction thereof by a spring member.

13. An ink bottle set-up device according to claim 1, wherein the ink bottle has a bottom wall formed with an ink discharging section, and the bottle set-up body has an ink receptor section to which the ink discharging section is coupled when the ink bottle is set up in the given position of the bottle set-up chamber.

14. An ink bottle set-up device according to claim 1, wherein the ink bottle has an information indicating rib, and the bottle set-up body has an information detecting sensor for detecting the information indicating rib.

15. An ink bottle set-up device setting up an ink bottle having a positioning projection, comprising:

a bottle set-up body having a bottle set-up chamber adapted to receive the ink bottle, and a projection-guide recess guiding the positioning projection; and an ink bottle erroneous set-up prevention mechanism including a projection detecting means for detecting that the positioning projection is inserted into the projection-guide recess, and a bottle stopper means for allowing the ink bottle to be inserted into the bottle set-up chamber, when the projection detecting means detects that the positioning projection is inserted into the projection-guide recess, for thereby enabling the ink bottle to be set up in a given position of the set-up chamber, the bottle stopper means preventing the ink bottle from being inserted into the bottle set-up chamber when the projection detecting means detects that the positioning projection is out of alignment with the projection-guide recess.

* * * * *